United States Patent [19]

Acuncius et al.

[11] 3,969,111

[45] July 13, 1976

[54] ALLOY COMPOSITIONS

[75] Inventors: Dennis S. Acuncius, Kokomo; Steven J. Matthews, Greentown, both of Ind.

[73] Assignee: Cabot Corporation, Kokomo, Ind.

[22] Filed: Mar. 27, 1975

[21] Appl. No.: 562,439

[52] U.S. Cl. ..... 75/171; 148/32.5; 148/162

[51] Int. Cl.[2] ..... C22C 19/05

[58] Field of Search ..... 75/171, 170; 148/32, 148/32.5, 162

[56] References Cited

UNITED STATES PATENTS 3,510,294 5/1970 Bieber et al. ..... 75/171

*Primary Examiner*—R. Dean

*Attorney, Agent, or Firm*—Buell, Blenko & Ziesenheim

[57] ABSTRACT

A nickel-base cast alloy is provided having high retention of ductility and high thermal stability on aging coupled with low thermal expansion and good oxidation resistance. Such alloy has a composition in weight percent within the range molybdenum 13.7 to 15.5%, chromium 14.7 to 16.5%, carbon 0.02% max., boron up to 0.02%, manganese 0.3 to 1.0%, silicon 0.2 to 0.75%, cobalt 2.0% max., iron 3.0% max., tungsten 1.0% max., aluminum 0.1 to 0.5% and the balance nickel, said alloy having an $N_v$ number between 2.23 and 2.31.

4 Claims, No Drawings

ALLOY COMPOSITIONS

This invention relates to alloy compositions and particularly to nickel-base cast alloys having high retention of ductility and high thermal stability on aging coupled with low thermal expansion and good oxidation resistance.

The present invention is directed to cast thermally stable high temperature nickel-base alloys and castings made therefrom and more particularly to an essentially non-ferrous, solid solution type, nickel-base alloy of the Ni-Cr-Mo class which possesses high thermal stability, high thermal strength, oxidation resistance up to about 1400°F., low thermal expansion and high retention of ductility on aging.

Great emphasis has been placed in recent years, in the field of solid solution strengthened nickel-base alloys, on attempts to provide improved structural material for use in equipment exposed to various high temperature conditions on the order of about 1600°F. and above. The field of jet engine manufacture is but one of the fields where there is and has been a continuing push to higher operating temperature levels in order to attain higher performance characteritics. In this prior art work, the primary emphasis has been in the field of wrought alloys.

Generally the area of cast alloys for use at somewhat lower temperatures (i.e., 1400°F.) has been essentially ignored or the higher temperature alloys have been used. This, of course, places a premium price material in a use where it is not really needed. Moreover, in addition to the problems outlined above in the wrought alloy field, the cast alloy field has also been faced with the problem of avoiding loss of ductility on aging particularly in those alloys subject to temperatures in the 1000°–1600°F range.

Thus, although many approaches have been tried in an effort to improve nickel-base alloys with regard to service life at temperatures in the range above 1600°F. there have been no alloys, to our knowledge, designed for use in the 1000°–1600°F. range and having a combination of superior oxidation and corrosion resistance, sustainable hot strength, thermal stability and retention of ductility on aging.

We have discovered a cast alloy and casting made therefrom which do, for the first time, attain all of these objectives. We have found that these objectives can be obtained by simultaneously controlling the composition of the alloy within certain limits while controlling the electron vacancy ($N_v$) number within narrow limits. Predicting the aged thermal stability of high temperature alloys using the $N_v$ electron vacancy approach is discussed in the *Journal of Metals* October 1962 by C. T. Sims.

We have discovered that, for castings which are characterized by good oxidation resistance, sustainable high hot strength, thermal stability and retention of ductility on aging, the following broad composition may be employed:

| | |
|---|---|
| Mo | 13.7% to 15.5% |
| Cr | 14.7% to 16.5% |
| C | 0.02% max. |
| B | Up to 0.02% |
| Mn | 0.3% to 1.0% |
| Si | 0.2% to 0.75% |
| Co | 2.0% max. |
| Fe | 3.0% max. |
| W | 1.0% max. |

-continued

| | |
|---|---|
| P | 0.02% max. |
| S | 0.015% max. |
| Al | 0.1% to 0.5% |
| Ni | Balance |

said alloy having an Nv number between 2.23 and 2.31. All compositions herein are in weight percent unless otherwise stated.

The specific composition which we prefer is:

| | |
|---|---|
| Mo | 14.0% |
| Cr | 15.5% |
| C | LAP (lowest amt. possible) |
| B | 0.01% |
| Mn | 0.5% |
| Si | 0.4% |
| Co | LAP |
| Fe | LAP |
| W | LAP |
| P | LAP |
| S | LAP |
| Al | 0.25% |
| Ni | Balance |

said alloy having an Nv number as close to 2.28 as possible but within the range 2.23 and 2.31.

The unique properties of this casting alloy and of castings produced therefrom can best be recognized by the following examples.

EXAMPLE I

Pin molds were poured under vacuum using a 20-pound remelt charge from a master heat. The chemical analyses of the castings are reported in Table I. Each mold produced 10, ½-inch diameter pins approximately 4 inches long from which tensile test bars were machined for testing. Samples from each casting were submitted for (1) metallographic examination, (2) tensile testing at room temperature (RT) and 1400°F., and (3) stress rupture testing at 1400°F. under a load of 25,000 psi. In addition, two samples from each casting were tensile tested at room temperature after aging for 1000 hours at 1600°F. Appropriate specimens were also machined from the bottom casting date and submitted for oxidation testing as follows:

Static Oxidation: Exposed to dry flowing air (7 cfh) at 1600°F. for 500 hours.

Dynamic Oxidation: Exposed to high velocity combustion gases (No. 2 fuel oil) at 1600°F. for 300 hours. Specimens were cycled out of the hot zone every 30 minutes.

TABLE I

CHEMICAL ANALYSIS OF ALLOY OF EXAMPLE I

| Element | Weight Percent |
|---|---|
| Ni | 69.07 |
| Cr | 15.55 |
| Mo | 14.14 |
| Al | .17 |
| B | .014 |
| Co | .01 |
| Cu | .01 |
| Fe | .10 |
| Mg | .01 |
| Mn | .43 |
| P | .005 |
| S | .01 |
| Si | .33 |
| Ti | .01 |
| W | .10 |
| C | .003 |
| Nv = 2.28 | |

The metallographic appearance of the cast pins revealed no undesirable structures.

Table II summarizes the mechanical properties of the alloy of Example I.

TABLE II

| SUMMARY OF MECHANICAL PROPERTIES DATA REPORTED IS AN AVERAGE OF TWO TESTS Property | |
|---|---|
| RT Yield | 36 ksi |
| RT Ultimate | 82 ksi |
| RT %E | 62% |
| RT %RA | 51% |
| RT* Yield | 35 ksi |
| RT* Ultimate | 76 ksi |
| RT* %E | 42% |
| RT* %RA | 33% |
| 1400°F Yield | 20 ksi |
| 1400°F Ultimate | 40 ksi |
| 1400°F %E | 33% |
| 1400°F %RA | 37% |
| 1400°F/25 ksi stress rupture life | 34 hours |

*After aging at 1600°F for 1000 hours.

Table III summarizes the environmental resistance of the castings.

TABLE III

| OXIDATION RESISTANCE OF NICKEL BASE ALLOY CASTINGS (DATA REPRESENT AVERAGE OF TWO TESTS) | | | | |
|---|---|---|---|---|
| Type Test | Test Temp. °F. | Time Hrs. | Value | |
| Static | 1600 | 500 | $M_L$(1) | .08 |
| Dynamic | 1600 | 300 | $M_L$(2) | 2.15 |

NOTES:
(1)$M_L$ is the metal loss in mils per side as determined by weight change after descaling.
(2)$M_L$ is the metal loss in mils per surface (determined by change in diameter of the specimen).

EXAMPLE II

The alloy of this invention was compared for elongation against two well-known commercially available, high performance nickel base cast alloys, Hastelloy* alloy B and Hastelloy* alloy C. The compositions of the alloys are set out in Table IV.

* TM Cabot Corp.

TABLE IV

| COMPOSITION OF CAST NICKEL BASE ALLOYS, wt/% | Hastealloy Alloy B | Hastelloy Alloy C | Alloy of Invention |
|---|---|---|---|
| Ni | Bal. | Bal. | Bal. |
| Mo | 28.0 | 17.0 | 14.5 |
| Cr | 0.8 | 16.5 | 15 |
| Al | — | — | 0.23 |
| B | — | — | 0.017 |
| C | 0.1 | 0.1 | Less than 0.002 |
| Co | 2.0 | 2.0 | 0.08 |
| Cu | — | — | Less than 0.01 |
| Fe | 5.0 | 6.0 | 0.09 |
| Mg | — | — | Less than 0.01 |
| Mn | 0.5 | 0.5 | 0.56 |
| Si | 0.5 | 0.5 | 0.34 |
| V | 0.2 | 0.2 | — |
| P | 0.015 | 0.015 | Less than 0.005 |
| S | 0.015 | 0.015 | Less than 0.006 |
| W | — | 4 | — |

Cast pins of the alloy invention specified in Example II were made by vacuum melting and pouring techniques. These pins were subjected to isothermal aging for various lengths of time and then machined into tensile test bars.

The mechanical properties are compared in Table V.

TABLE V

| ELONGATION, % | Tensile at | Hastelloy Alloy B | Hastelloy Alloy C | Alloy of Invention |
|---|---|---|---|---|
| As Cast | R.T. | 6 | 11 | 62 |
| Aged 1475°F | R.T. | 5 | 0 | 26 |
| for 100 hrs. | 1500°F | 10 | 22 | 37 |
| Aged 1475°F | R.T. | 3 | 2 | 21 |
| for 1000 hrs. | 1500°F | 4 | 6 | 17 |
| Aged 1600°F for 16 hrs. | R.T. | — | 2 | 30 |

The foregoing data show the unusually high values of elongation in the as cast condition and after aging which characterize the alloy of this invention.

In the foregoing specification we have set out certain preferred embodiments of this invention, however, it will be understood that this invention may be otherwise embodied within the scope of the following claims.

We claim:

1. A cast alloy composition having high thermal stability and oxidation resistance up to about 1600°F., and high retention of ductility on aging consisting essentially of:

| | |
|---|---|
| Mo | 13.7% to 15.5% |
| Cr | 14.7% to 16.5% |
| C | 0.02% max. |
| B | Up to 0.015% |
| Mn | 0.3% to 1.0% |
| Si | 0.2% to 0.75% |
| Co | 2.0% max. |
| Fe | 3.0% max. |
| W | 1.0% max. |
| P | 0.02% max. |
| S | 0.015% max. |
| Al | 0.1% to 0.5% |
| Ni | Balance |

said alloy having an Nv number between 2.23 and 2.31.

2. A cast alloy as claimed in claim 1 wherein the composition consists essentially of:

| | |
|---|---|
| Mo | 14.0% |
| Cr | 15.5% |
| C | LAP (lowest amt. possible) |
| B | 0.01% |
| Mn | 0.5% |
| Si | 0.4% |
| Co | LAP |
| Fe | LAP |
| W | LAP |
| P | LAP |
| S | LAP |
| Al | 0.25% |
| Ni | Balance |

said alloy having an Nv number as close to 2.28 as possible but within the range 2.23 and 2.31.

3. An alloy casting made from an alloy consisting essentially of:

| | |
|---|---|
| Mo | 13.7% to 15.5% |
| Cr | 14.7% to 16.5% |
| C | 0.02% max. |
| B | Up to 0.015% |
| Mn | 0.3% to 1.0% |
| Si | 0.2% to 0.75% |
| Co | 2.0% max. |
| Fe | 3.0% max. |
| W | 1.0% max. |

-continued

| | |
|---|---|
| P | 0.02% max. |
| S | 0.015% max. |
| Al | 0.1% to 0.5% |
| Ni | Balance |

said alloy having an Nv number between 2.23 and 2.31 and characterized by thermal stability and oxidation resistance to about 1600°F., low thermal expansion and high retention of ductility on aging.

4. An alloy casting made from an alloy consisting essentially of:

| | |
|---|---|
| Mo | 14.0% |
| Cr | 15.5% |
| C | LAP (lowest amt. possible) |

-continued

| | |
|---|---|
| B | 0.01% |
| Mn | 0.5% |
| Si | 0.4% |
| Co | LAP |
| Fe | LAP |
| W | LAP |
| P | LAP |
| S | LAP |
| Al | 0.25% |
| Ni | Balance |

said alloy having an Nv number as close to 2.28 as possible but within the range 2.23 and 2.31 and characterized by thermal stability oxidation resistance to about 1600°F., low thermal expansion and high retention of ductility on aging.

* * * * *

UNITED STATES PATENT OFFICE

CERTIFICATE OF CORRECTION

PATENT NO. : 3,969,111

DATED : July 13, 1976

INVENTOR(S) : Dennis S. Acuncius and Steven J. Matthews

It is certified that error appears in the above-identified patent and that said Letters Patent are hereby corrected as shown below:

Column 1, line 54, "1962" should read --1966--.

Column 2, line 43 , "date" should read --gate--.

Column 3, line 51, "Hastealloy" should read --Hastelloy--.

Signed and Sealed this

Tenth Day of May 1977

[SEAL]

*Attest:*

RUTH C. MASON
*Attesting Officer*

C. MARSHALL DANN
*Commissioner of Patents and Trademarks*